US005851980A

United States Patent [19]

Avery

[11] Patent Number: 5,851,980

[45] Date of Patent: Dec. 22, 1998

[54] LIQUID HARD SURFACE CLEANER COMPRISING A MONOCARBOXYLATE ACID AND AN AMPHOLYTIC SURFACTANT HAVING NO CARBOXYL GROUPS

[75] Inventor: Richard W. Avery, High Wycombe, England

[73] Assignee: S. C. Johnson & Sons, Inc., Racine, Wis.

[21] Appl. No.: 680,337

[22] Filed: Jul. 10, 1996

[51] Int. Cl.[6] ..... C11D 1/92; C11D 3/43; C11D 7/08

[52] U.S. Cl. ..... 510/424; 510/235; 510/238; 510/245; 510/253; 510/254; 510/362; 510/363; 510/365; 510/423; 510/433; 510/434; 510/472; 510/477

[58] Field of Search ..... 510/235, 238, 510/245, 253, 254, 362, 363, 365, 423, 433, 434, 472, 477

[56] References Cited

U.S. PATENT DOCUMENTS

| | | | |
|---|---|---|---|
| 3,663,327 | 5/1972 | Ritzi | 156/21 |
| 3,715,292 | 2/1973 | Wieczorek | 204/145 R |
| 4,765,921 | 8/1988 | Rousset et al. | 252/87 |
| 4,812,253 | 3/1989 | Small et al. | 252/132 |
| 5,008,030 | 4/1991 | Cook et al. | 252/106 |
| 5,061,393 | 10/1991 | Linares et al. | 252/143 |
| 5,078,991 | 1/1992 | Birtwistle et al. | 424/70 |
| 5,362,422 | 11/1994 | Masters | 252/544 |
| 5,403,517 | 4/1995 | Horinishi et al. | 252/551 |
| 5,411,585 | 5/1995 | Avery et al. | 106/287.3 |
| 5,447,575 | 9/1995 | Crump et al. | 134/42 |
| 5,498,293 | 3/1996 | Ilardi et al. | 134/3 |
| 5,531,933 | 7/1996 | Masters et al. . | |
| 5,536,450 | 7/1996 | Masters et al. . | |
| 5,607,980 | 3/1997 | McAtee et al. | 514/476 |
| 5,609,168 | 3/1997 | Kischka et al. | 132/204 |
| 5,614,180 | 3/1997 | Chung | 424/70.19 |
| 5,629,278 | 5/1997 | Baeck et al. | 510/236 |
| 5,698,041 | 12/1997 | Woo et al. | 134/3 |

FOREIGN PATENT DOCUMENTS

| | | |
|---|---|---|
| 254653 | 1/1988 | European Pat. Off. . |
| 623669 | 11/1994 | European Pat. Off. . |
| 56-145-997 | 11/1981 | Japan . |
| 58-021-496 | 2/1983 | Japan . |

*Primary Examiner*—Paul Lieberman
*Assistant Examiner*—Charles Boyer

[57] ABSTRACT

Disclosed herein are hard surface cleaners and methods for creating and using them. The cleaners combine a monocarboxylic acid with an ampholytic surfactant having no carboxyl groups, in an aqueous solution. In one aspect, lactic acid, water, and sodium caprylo ampho hydroxpropyl sulphonate are present.

12 Claims, No Drawings

LIQUID HARD SURFACE CLEANER COMPRISING A MONOCARBOXYLATE ACID AND AN AMPHOLYTIC SURFACTANT HAVING NO CARBOXYL GROUPS

TECHNICAL FIELD

The present invention relates to non-abrasive liquid cleaning compositions. It appears to be especially well suited for use as a bathroom tub and tile cleaner.

BACKGROUND ART

The art has developed a variety of hard surface cleaning compositions which are abrasive powders, or are solutions containing abrasive particles. However, such cleaners are perceived by some consumers as being more likely to scratch decorative surfaces such as ceramic tiles. In the case of such solutions, they sometimes also have stability problems such as separation of abrasive particles either by sedimentation or by flotation.

Thus, there have been attempts to develop hard surface cleaners that are non-abrasive. For example, one embodiment of U.S. Pat. No. 5,008,030 is a cleaning composition that contains nonionic surfactants, a monocarboxylic acid, water, and other additives. The disclosure of this patent and of all other patents described herein are incorporated by reference as if fully set forth herein. Another example is U.S. Pat. No. 5,061,393, which teaches a hard surface cleaner that is a mixture of a zwitterionic surfactant, nonionic surfactant, citric acid, and various other components.

While cleaners of this type avoid the use of abrasives, they have less than optimal soap scum and/or lime scale removal properties. Attempts to improve their performance in these areas without resorting to abrasives have been constrained by competing concerns such as avoiding leaving films, spots, or streaks, not raising environmental concerns, and not using ingredients which are incompatible with use by ordinary consumers or with other desired cleaner components. For example, some silane waterproofing additives are incompatible with some surfactants.

Thus, a need exists for an improved non-abrasive hard surface cleaner, particularly with respect to soap scum and lime scale removal capabilities.

DISCLOSURE OF INVENTION

In one aspect, the invention provides a hard surface cleaner in the form of an aqueous solution of a monocarboxylic acid and an ampholytic (a/k/a amphoteric) surfactant having no carboxyl

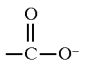

groups. The surfactant is preferably a sulphonate surfactant, and the acid is preferably selected from the group consisting of lactic acid, formic acid, acetic acid, propionic acid, butyric acid, valeric acid, hexanoic acid, glycolic acid, gluconic and other monocarboxylic acids containing only carbon, hydrogen and oxygen which have seven or less carbons (e.g. peroxy variants of these acids such as peroxyacetic acid).

Ampholytic surfactants are those which have two or more functional groups which, depending on the condition of the medium, can be ionized in an aqueous solution and give to the compound the characteristics of an anionic or cationic surfactant. Those that are the subject of the present invention have no carboxyl groups, have a sulphonate or other anionic group (usually in the form of a salt, e.g. a sodium salt), have a cationic group (e.g. usually nitrogen, but in some embodiments sulfer or phosphorus) elsewhere on the surfactant, and have less than thirty carbons overall. The most preferred surfactant is sodium capryloamphohydroxypropyl sulphonate.

It has been surprisingly learned that ampholytic sulfonate surfactants having no carboxyl groups, in combination with monocarboxylic acids, provide greatly improved scum and lime scale removal, without sacrificing other desired characteristics. One of the reasons this is especially surprising is that it had previously been thought that the presence of multiple carboxyl groups was important in achieving good sequestration effects with such cleaners. Here, not only is performance not sacrificed with reduced carboxyl, it is significantly increased. It is believed that this is partly because of the ability of these surfactants to permit high concentrations of the acids and other cleaner components to remain in solution in an acidic pH.

The present compositions are water based ("aqueous") solutions, albeit in the preferred form water soluble organic solvents (e.g. glycol ether solvents) can also be added. At least 20% by weight (preferably at least 50% by weight) of the cleaner is water. Deionized water is used to avoid adding calcium deposits or chlorine (which might interfere with added fragrance or lime removal). Optimal components such as nonionic surfactants, disinfectants, fragrance, rinse aids and waterproofers can also be added.

The acid and surfactant are each preferably less than 10% by weight of the cleaner, with the surfactant especially preferably being between 1% and 8% by weight of the cleaner.

In another aspect, the invention provides a method for cleaning a hard surface comprising rubbing the above cleaner against the hard surface, followed by rinsing the surface with additional water. If no rubbing is desired, the cleaner can be applied, allowed to remain in contact with the hard surface for a sufficient time so that cleaning occurs, followed by a rinse.

In yet another aspect, the invention comprises a method of forming such compositions by mixing the surfactant, water, and acid together, followed by agitation or spraying of the mixture.

The objects of the present invention therefore include providing non-abrasive cleaning compositions of the above kind:

(a) having desirable soap scum and lime scale removal characteristics;

(b) which have acceptable characteristics with respect to minimizing spotting, streaking, and film residue; and (c) which use only environmentally acceptable materials.

These and still other objects and advantages of the present invention will be apparent from the description which follows. The following description is merely of the preferred embodiments. The claims should therefore be looked to in order to understand the fill scope of the invention.

BEST MODES FOR CARRYING OUT THE INVENTION

A preferred bathroom tile and tub cleaner has the following formula:

| Ingredient | Weight % |
|---|---|
| Deionized Water | 78.619% |
| Lactic Acid 88% (12% water) | 6.8% |
| Dipropylene glycol monobutyl ether | 4.5% |
| Ethoxylate L12-8 (aC10–C12 Linear Ethoxylated Alcohol, 8 moles EO) | 3.6% |
| Sodium capryloampho hydroxypropyl sulphonate (Miranol JS) 49% active | 3.061% |
| Dipropylene glycol n-propyl ether | 2.5% |
| N-Alkyldimethyl benzyl ammonium chloride, 50% | .43% |
| Fragrance | .25% |
| Organo silane 2-C10 | .24% |
| | 100% |

The two glycol ethers are degreasing solvents. The ethoxylate (obtained from Huntsman Corp.) is a nonionic surfactant that improves removal of certain soils. See generally U.S. Pat. No. 5,008,030.

The N-alkyldimethyl benzyl ammonium chloride is a stabilizer desirable when using silane waterproofers, and also acts as a disinfectant. The organosilane (obtained from Sanitized Inc.) is a rinse aid and also provides longer term waterproofing protection. See generally U.S. Pat. No. 5,411,585.

The most preferred ampholytic surfactant is sodium capryloampho hydroxypropyl sulphonate. It has the following structure:

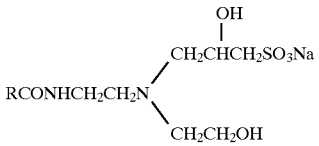

where the R is $CH_3(CH_2)_6$.

The preferred amphoteric surfactant was obtained from Rhône Poulene in 49% active form as Miranol® JS. conc.

The above cleaner was prepared at room temperature as follows. Deionized water was added to a clean process vessel and agitation began. Agitation was maintained throughout the remainder of the batch. The lactic acid was then added, followed by the ethoxylated C10-12 alcohol. The batch was then agitated for 10 minutes before proceeding to next addition. The monobutyl ether, the surfactant, and the n-propyl ether were then added. Next, the N-Alkyldimethyl benzyl ammonium chloride was added, followed by the organosilane quat di-C10. Fragrance was then added to the batch and agitated for 30 more minutes. Next the product was filtered through a 10 micron bag.

To test the relative effectiveness of the above formula, the following tests were used. In one test a soap scum/alcohol mix was dried on a surface. Several drops of each cleaner were placed on the surface. The removal percent (without rubbing) was then compared over a fixed time. In another test a variation of an ASTM standard method was followed which comprises removal with rubbing pressure. In both tests, significantly better cleaning was observed using the present invention when compared to a state of the art cleaner.

In a third test, the lime dissolving capabilities of the above formula were evaluated by visual and quantitative examination of standard marble pieces dipped in cleaners for a fixed time. By this test method, pieces of marble are weighed and placed in a container with products after 15 hours the pieces of marble are recovered rinsed well and dried with tissue. Next the pieces are dried at 60° C. in a crossflow oven for one hour and reweighed. Again, the present invention performed significantly better when compared to a state of the art cleaner.

The invention is not limited to just using lactic acid in combination with sodium capryloampho hydroxypropyl sulphonate. Rather, it also includes various other monocarboxylic acids having seven or less carbons (and only carbon, hydrogen and oxygen). Further, other ampholytic surfactants with no carboxyl groups are intended to be covered. An additional example is sodium cocoampho hydroxy propyl sulphonate (where RCO in the prior Miranol JS formula is instead derived from various fatty acids from coconut oil—Miranol®CS).

Another class of sulphonates for the present invention are sultaines (e.g. cocoamidopropyl hydroxy sultaine—Miretaine®CBS):

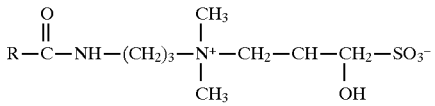

where RCO is again various fatty acids from coconut oil or coco-hydroxy sultaine:

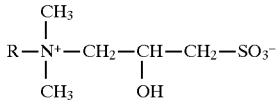

(Amonyl 673 SB from Seppic, where R is alkyl groups of coconut oil fatty acids).

Another class of sulfonates for the invention are the taurates, such as:

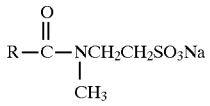

where R is $CH_3(CH_2)_{10}$ (sodium methyl lauryl taurate—Nikkol LMT from Nikko) in one embodiment, or:

$$RNHCH_2CH_2SO_3Na$$

In the alternative, for any of the sulphonates herein, the R can be other alkyl (less than twenty carbons, e.g. saturated, unsaturated, linear, branched, ring).

While ampholytic sulphonates are highly preferred, other ampholytic surfactants with no carboxyl groups are also believed useful for the present invention such as sulfitobetaines, sulfatobetaines, sulfite sulfoniobetaines, phosphoniobetaines, and amido hydroxyl phostaines (e.g. sodium lauramidopropyl phostaine).

INDUSTRIAL APPLICABILITY

This invention is useful in cleaning hard surfaces, and in particular bathroom tubs and tiles.

We claim:

1. A hard surface cleaner, comprising a. at least 50% by weight of water;

b. a monocarboxylic acid selected from the group consisting of lactic acid, valeric acid, hexanoic acid, and glycolic acid, c. at least 1% by weight of an ampho hydroxypropyl sulplionate surfactant and, d. an amount of organic solvent soluble in the cleaner sufficient to assist in the removal of soap scum from a hard surface, said cleaner having an acidic pH.

2. The hard surface cleaner of claim 1 wherein the ampho hydroxypropyl sulphonate surfactant is selected from the group consisting of sodium capryloampho hydroxypropyl sulphonate and sodium cocoampho hydroxypropyl sulphonate.

3. The cleaner of claim 1, wherein the organic solvent is a glycol ether solvent.

4. The cleaner of claim 1, wherein the acid is lactic acid.

5. The cleaner of claim 4, wherein the lactic acid is at least 1% by weight of the cleaner.

6. A method for cleaning a hard surface comprising rubbing the cleaner of claim 1 against the hard surface, followed by rinsing the surface with water.

7. A method of producing the cleaner of claim 1, comprising mixing the monocarboxylic acid of claim 1 with the surfactant of claim 1 and water, and agitating the mixture.

8. A method of cleaning a hard surface comprising the steps of (1) applying a cleaner to a hard surface, said cleaner comprising (a) at least 50% by weight of water; (b) a monocarboxylic acid selected from the group consisting of lactic acid, valeric acid, hexanoic acid, and glycolic acid, and (c) at least 1% by weight of an ampho hydroxypropyl sulphonate surfactant, said cleaner having an acidic pH; (2) allowing the cleaner to remain in contact with the surface for a sufficient amount of time so that cleaning occurs; and (3) rinsing the surface with water.

9. The method of cleaning of claim 8, wherein the acid is lactic acid.

10. The method of cleaning of claim 9, wherein the surfactant is sodium capryloampho hydroxypropyl sulphonate.

11. The method of cleaning of claim 8, wherein the lactic acid is at least 1% by weight of the cleaner.

12. The method of cleaning of claim 8, wherein the cleaner further comprises a glycol ether solvent.

* * * * *

UNITED STATES PATENT AND TRADEMARK OFFICE

CERTIFICATE OF CORRECTION

PATENT NO. : 5,851,980
DATED : December 22, 1998
INVENTOR(S) : Richard W. Avery

It is certified that error appears in the above-identified patent and that said Letters Patent is hereby corrected as shown below:

Claim 1,
Line 4, after "lactic acid," please insert -- butyric acid, --.

Claim 8,
Line 5, after "lactic acid," please insert -- butyric acid, --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*